US006672976B2

(12) United States Patent
Watanabe

(10) Patent No.: US 6,672,976 B2
(45) **Date of Patent: *Jan. 6, 2004**

(54) MULTI-PIECE SOLID GOLF BALL

(75) Inventor: Hideo Watanabe, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 173 days.

This patent is subject to a terminal disclaimer.

(21) Appl. No.: 09/853,749

(22) Filed: May 14, 2001

(65) Prior Publication Data

US 2001/0055998 A1 Dec. 27, 2001

(30) Foreign Application Priority Data

May 15, 2000 (JP) ..... 2000-141541

(51) Int. Cl.[7] ..... A63B 37/04; A63B 37/06; A63B 37/14; A63B 37/12; A63B 37/00

(52) U.S. Cl. ..... 473/377; 473/378; 473/383; 473/371; 473/351

(58) Field of Search ..... 473/351, 354–365, 473/367–378, 383, 385

(56) References Cited

U.S. PATENT DOCUMENTS 4,681,323 A * 7/1987 Alaki et al. ..... 273/DIG. 22
4,840,381 A * 6/1989 Ihara et al. ..... 473/365
5,242,652 A * 9/1993 Savigny ..... 264/101
5,752,889 A * 5/1998 Yamagishi et al. .. 273/DIG. 20
5,779,563 A * 7/1998 Yamagishi et al. ..... 473/371
5,782,707 A * 7/1998 Yamagishi et al. ..... 473/373
5,803,834 A * 9/1998 Yamagishi et al. ..... 473/372
5,820,492 A * 10/1998 Yamagishi et al. ..... 473/372
5,823,888 A * 10/1998 Maruko et al. ..... 273/DIG. 20
5,846,141 A 12/1998 Morgan et al.
5,863,264 A * 1/1999 Yamagishi et al. .. 273/DIG. 20
5,911,639 A * 6/1999 Kasashima et al. ..... 473/377
5,967,908 A * 10/1999 Yamagishi et al. ..... 473/373
6,039,660 A * 3/2000 Kasashima et al. ..... 473/378
6,053,820 A * 4/2000 Kasashima et al. ..... 473/378
6,210,292 B1 * 4/2001 Higuchi et al. ..... 473/374
2002/0155902 A1 * 10/2002 Hayashi et al. ..... 473/371

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A golf ball includes a core and a multi-layer cover. The golf ball satisfies the following conditions (1) to (5): (1) the number of dimples is 360 to 492; (2) total volume enclosed by the dimples as expressed as a percentage of the volume of the golf ball, $V_R$, is 0.715% to 0.825%; (3) total surface area of the dimples as expressed as a percentage of the surface area of the golf ball, $S_R$, is not less than 70%; (4) value obtained through subtraction of the JIS C hardness of the surface portion of the core from the average JIS C hardness of the cover is 0 to 20; and (5) initial velocity is in excess of 77.7 m/s (255 ft/s).

10 Claims, 2 Drawing Sheets

MULTI-PIECE SOLID GOLF BALL

BACKGROUND OF THE INVENTION

1. Field of the Invention

The present invention relates to a multi-piece solid golf ball including a core and a multi-layer cover, and more particularly to a golf ball enabling a golfer who has a rather low club head speed to drive the ball a long distance.

2. Description of the Related Art

U.S. Pat. No. 5,846,141 discloses a golf ball having an initial velocity in excess of 255 feet/s (77.7 m/s) when tested under the conditions set forth in the Royal and Ancient Golf Club of St. Andrews (R&A) and the United States Golf Association (USGA) and traveling less than 296.8 yards (271.4 m) in carry and run when tested under the conditions set forth in R&A and USGA.

The golf ball described in U.S. Pat. No. 5,846,141 has a core and a cover and an initial velocity in excess of 255 feet/s (77.7 m/s) when tested under the conditions set forth in the applicable rule established by USGA, and travels less than 296.8 yards in carry and run when tested under the conditions set forth in the applicable rule. According to the publication, since the golf ball has an initial velocity in excess of that prescribed by R&A and USGA, the golf ball enables a golfer who has a rather low club head speed to drive the ball a long distance.

However, U.S. Pat. No. 5,846,141 does not specifically disclose how the initial velocity of the golf ball is increased, and those skilled in the art have encountered difficulty in embodying a golf ball having an increased initial velocity from the publication.

SUMMARY OF THE INVENTION

In view of the foregoing, it is an object of the present invention to provide a multi-piece solid golf ball having an increased initial velocity implemented through specification of conditions with respect to dimples, core hardness, and cover hardness, among others, to thereby enable a golfer who has a rather low club head speed to drive the ball a long distance.

To achieve the above object, the present invention provides a multi-piece solid golf ball comprising a core and a multi-layer cover, the golf ball satisfying the following conditions (1) to (5):

(1) the number of dimples is 360 to 492;

(2) total volume enclosed by the dimples as expressed as a percentage of the volume of the golf ball, $V_R$, is 0.715% to 0.825%;

(3) total surface area of the dimples as expressed as a percentage of the surface area of the golf ball, $S_R$, is not less than 70%;

(4) value obtained through subtraction of JIS C hardness of a surface portion of the core from average JIS C hardness of the cover is 0 to 20; and (5) initial velocity is in excess of 77.7 m/s (255 ft/s).

In the present invention, the $V_R$ (volume ratio), the $S_R$ (surface ratio), the average JIS C hardness of the cover, and the initial velocity have the following meanings.

[$V_R$]

$V_R$ (%) is expressed as below.

[Expression 1]

$$V_R = \frac{V_S}{\frac{4}{3}\pi R^3} \times 100$$

(where $V_S$ is total space volume of dimples, each having a dimple space volume $V_P$, and R is the radius of the golf ball (an imaginary sphere). The dimple space volume $V_P$ is defined as the volume of a space enclosed by a dimple surface and a plane surrounded by an edge of the dimple.)

$V_S$ appearing above in Exp. 1 is expressed below by Exp. 2. $V_S$ obtained from Exp. 2 is substituted into Exp. 1 to thereby obtain $V_R$.

[Expression 2]

$$V_S = N_1 V_{P1} + N_2 V_{P2} + \ldots + N_n V_{Pn} = \sum_{i=1}^{n} N_i V_{Pi}$$

(where $V_{P1}, V_{P2}, \ldots, V_{Pn}$ each represent the volume of a dimple, the dimples being of different shapes. $N_1, N_2, \ldots, N_n$ each represent the number of dimples having the respective one of volumes $V_{P1}, V_{P2}, \ldots, V_{Pn}$. n is an integer equal to or greater than 1.)

A method for obtaining the dimple space volume $V_P$ will next be described with respect to a dimple having a circular shape as viewed from above. Referring to FIG. 1, an imaginary spherical surface 5 having the diameter of the ball is formed on a dimple 4, and an imaginary spherical surface 6 having a diameter 0.16 mm smaller than the diameter of the ball is formed as well. A dimple edge 10 is defined as a collection of intersections 9, each of which is an intersection of the imaginary spherical surface 5 and a tangent 8 to the dimple 4 at an intersection 7 of the imaginary spherical surface 6 and the dimple 4. Since an edge portion of the dimple 4 is usually rounded, the dimple edge 10 is thus defined for clarity. Referring to FIGS. 2 and 3, the dimple space volume $V_P$ of a dimple space 12 is obtained on the basis of a plane (a circle having a diameter $D_m$) 11 surrounded by the dimple edge 10 and a distance (a dimple depth $D_p$) between the plane 11 and the bottom of the dimple space 12. When dimples of a single type are involved, the product of the dimple space volume $V_P$ and the number of dimples is obtained. When dimples of two or more types are involved, the product of the dimple space volume $V_P$ and the number of dimples is obtained for each type of dimples. The thus-obtained product(s) is used to obtain the total space volume of dimples $V_S$ according to Exp. 2. The thus-obtained $V_S$ is used to obtain the total volume enclosed by dimples as expressed as a percentage of the volume of a golf ball, $V_R$, according to Exp. 1.

[$S_R$]

$S_R$(%) is expressed as below. A dimple edge is defined as in the case of $V_R$ described above.

[Expression 3]

$$S_R = \frac{S_S}{4\pi R^2}$$

(where $S_S$ is total surface area of dimples, and R is the radius of a golf ball (an imaginary sphere). The surface area of a dimple is defined as the area of a dimple surface below the plane surrounded by the dimple edge.)

[Average JIS C hardness of the Cover]

The average JIS C hardness of the cover is a value obtained by dividing the sum of the product, for each layer, of JIS C hardness and thickness, by the sum of the thicknesses of the layers. In an example case in which the cover has two layers, the average JIS C hardness of the cover is calculated by the following formula.

$$\text{Average JIS C hardness of the cover}=(A\times X+B\times Y)/(X+Y),$$

where A is the JIS C hardness of the first cover layer, X is the thickness of the first cover layer, B is the JIS C hardness of the second cover layer, and Y is the thickness of the second cover layer.

In an example case in which the cover has three layers, the average JIS C hardness of the cover is calculated by the following formula.

$$\text{Average JIS C hardness of the cover}=(A\times X+B\times Y+C\times Z)/(X+Y+Z)$$

where A is the JIS C hardness of the first cover layer, X is the thickness of the first cover layer, B is the JIS C hardness of the second cover layer, Y is the thickness of the second cover layer, C is the JIS C hardness of the third cover layer, and Z is the thickness of the third cover layer.

[Initial Velocity]

Initial velocity is measured on an initial velocity meter similar to a drum-rotation-type initial velocity meter of USGA approved by R&A. A ball is conditioned for a minimum of 3 hours at 23±1° C. and is then tested in a room conditioned to 23±2° C. The ball is struck by a club head (a striking mass) of approximately 250 lbs (113.4 kg) at a striker velocity of 143.8 ft/s (43.83 m/s). A dozen balls are struck four times each. Time required to pass through a distance of 6.28 ft (1.88 mm) is measured to thereby calculate initial velocity. The cycle is completed in approximately 15 minutes.

Other and further objects, features and advantages of the present invention will be more apparent from the following description.

DESCRIPTION OF THE INVENTION AND PREFERRED EMBODIMENTS

Figure 1:
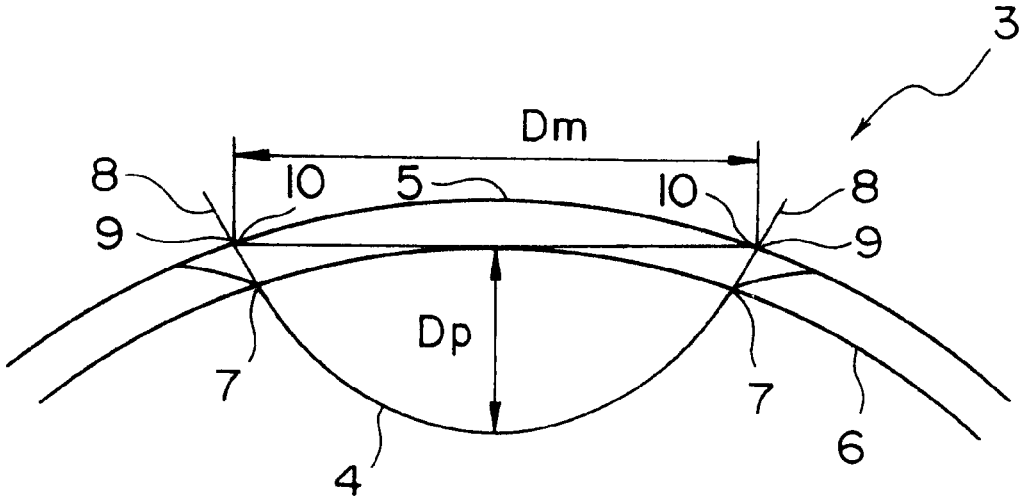
FIG. 1 is a view showing a method for obtaining a dimple space volume.
Figure 2:
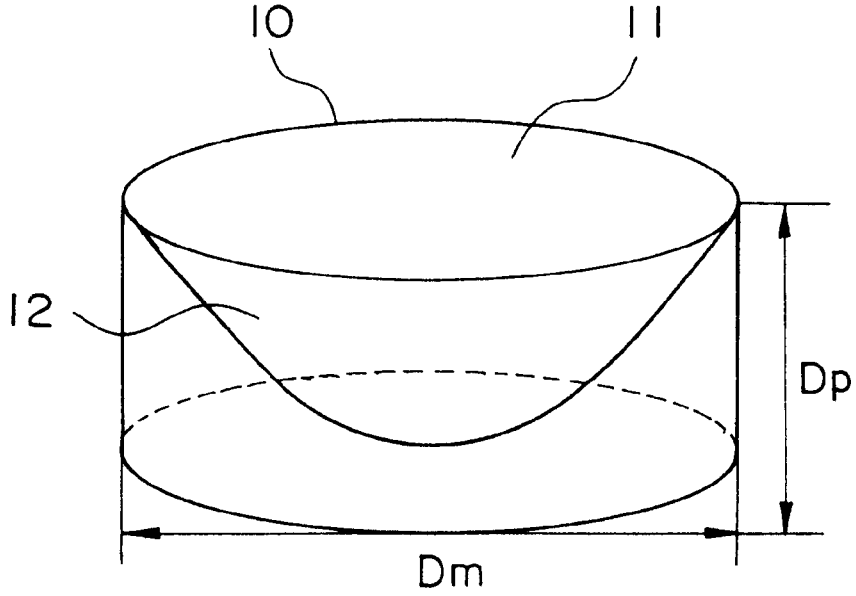
FIG. 2 is a view showing a method for obtaining a dimple space volume.
Figure 3:
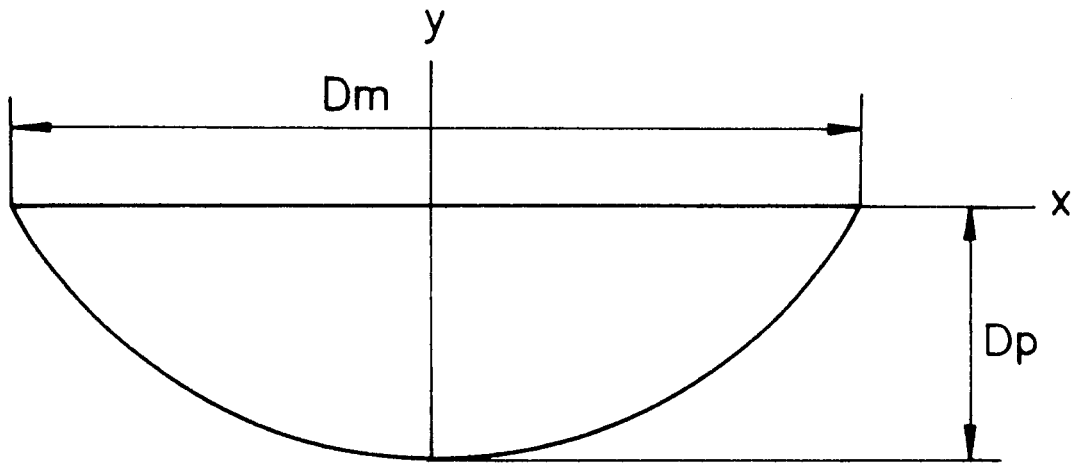
FIG. 3 is a view showing a method for obtaining a dimple space volume.

The present invention will next be described in detail. A golf ball of the present invention has 360 to 492 dimples. When the number of dimples is less than 360, optimum lift cannot be obtained, resulting in a decrease in travel distance. When the number of dimples is in excess of 492, trajectory lowers, with a resultant failure to yield sufficient travel distance. A preferred range of the number of dimples is 380 to 460.

The golf ball of the present invention has a $V_R$ of 0.715% to 0.825%. When $V_R$ is less than 0.715%, the ball pops up with a resultant decrease in travel distance. When $V_R$ is in excess of 0.825%, trajectory becomes too low, resulting in an excessive decrease in carry. A preferred range of $V_R$ is 0.73% to 0.80%.

The golf ball of the present invention has an $S_R$ not less than 70%. When $S_R$ is less than 70%, the optimum lift-to-drag ratio is not obtained, with a resultant failure to yield sufficient travel distance. A more preferred range of $S_R$ is 72% to 80%.

The golf ball of the present invention is designed such that the above-described value obtained through subtraction of the JIS C hardness of a surface portion of the core from the average JIS C hardness of the cover falls within a range of 0 to 20. When the value is less than 0, the spin of the golf ball (in particular, the spin upon being hit by a driver) increases, with the result that the travel distant decreases and the durability of the ball against cracking is impaired. In other words, when the above-described value becomes less than 0, this means that the average hardness of the cover decreases, or the core becomes harder, either case resulting in an increase in the spin of the golf ball (in particular, the spin upon being hit by a driver). Further, when a hard outermost layer and a soft inner layer are used for forming a multi-layer cover, the durability of the ball against cracking may be impaired. On the other hand, when the value exceeds 20, the feeling upon being hit by a driver becomes excessively soft, the feeling upon being hit by a putter becomes excessively hard, and the durability of the ball against cracking is impaired. That is, when the above-described value exceeds 20, this means that a hard multi-layer cover is combined with a soft core, whereby the feeling upon being hit by a driver becomes soft. Further, when a hard cover is combined with a soft core, generally the durability of the ball against cracking is impaired. If the thickness of the cover is increased in order to prevent this drawback, hit feeling upon hit with a putter becomes hard. Preferably, the above-described value falls within a range of 3 to 15.

The golf ball of the present invention has an initial velocity in excess of 77.7 m/s (255 ft/s) when tested under the conditions set forth in R&A and USGA. When the initial velocity is not higher than 77.7 m/s, the ball travels merely a distance over which a conventional ball travels. A preferred range of initial velocity is 78.0 m/s or higher.

Next, layer components of the golf ball of the present invention will be described. A core material is not particularly limited. For example, vulcanized rubber containing a predominant amount of polybutadiene rubber, polyisoprene rubber, natural rubber, or silicone rubber can be used. However, vulcanized rubber containing a predominant amount of polybutadiene rubber is particularly preferred.

In the present invention, pentachlorothiophenol or a metallic salt of pentachlorothiophenol is added to a core material to thereby form a core having high initial velocity; and a relatively hard layer (for example, a layer having a Shore D hardness of 60 or higher) is used as an outermost cover layer. In this manner, a golf ball having an initial velocity in excess of 77.7 m/s can be yielded easily. Pentachlorothiophenol or a metallic salt of pentachlorothiophenol is preferably a zinc salt of pentachlorothiophenol; for example, Renacit IV (product of Bayer Corp.).

A core may assume a single-layer structure formed of a single material or a multi-layer structure composed of two or more layers of different materials. In the case of a multi-layer core, "JIS C hardness of a surface portion of a core" appearing previously means the hardness of a surface portion of the outermost layer of the core. The outermost layer of the core is preferably made of a rubber material similar to that which a center is made of.

In the golf ball of the present invention, the outermost cover layer may be made of an ionomer resin or a mixture of a predominant amount of an ionomer resin and a polyester resin, a polyurethane resin, a polyamide resin, or a polyolefin resin. Particularly, ionomer resins such as those commercially available from Du Pont, Ltd. under the trade name Surlyn and from Du Pont Mitsui Polychemicals Co., Ltd. under the trade name Himilan are preferred. The cover layer disposed inside the outermost cover layer may be formed of a known material. Specific examples of such a known material include an ionomer resin, a polyester resin, a polyamide resin, a polyurethane resin, a polyolefin resin, and a mixture of these resins.

In the golf ball of the present invention, the outermost cover layer preferably has a Shore D hardness of 53 to 66, more preferably 55 to 65, most preferably 58 to 63. When the outermost cover layer is excessively soft, the initial speed of the ball may fail to exceed 77.7 m/s (255 ft/s), or the spin upon being hit by a driver may increase with a resultant decrease in travel distance. When the outermost cover layer is excessively hard, the hit feeling may become excessively hard, and the durability of the ball against cracking may be impaired. No particular limitation is imposed on the hardness of the cover layer disposed inside the outermost cover layer.

In the golf ball of the present invention, the above-described value obtained through subtraction of the average JIS C hardness of the inner cover layer(s) (one or more cover layers present inside the outermost cover layer) from the JIS C hardness of the outermost cover layer generally falls within a range of −10 to 40, and preferably falls within a range of −5 to 35. When the value is excessively low, the initial speed of the ball may fail to exceed 77.7 m/s (255 ft/s), or the spin upon being hit by a driver may increase with a resultant decrease in travel distance. When the value is excessively high, the initial speed of the ball may fail to exceed 77.7 m/s (255 ft/s), or the durability of the ball against cracking may be impaired.

In the golf ball of the present invention, no particular limitation is imposed on the number of cover layers. However, when the number of cover layers is excessively large, the initial speed of the ball may fail to exceed 77.7 m/s (255 ft/s). Therefore, the number of cover layers is not greater than 4, is preferably 3, more preferably 2.

The thus-obtained golf ball may be finished through application of coating to the surface and stamping the surface with marking as needed. The hardness of the ball as represented by the amount of deformation under a load of 100 kg is preferably 2.0 mm to 3.5 mm, more preferably 2.3 mm to 3.0 mm. The ball can be formed in such a manner as to have a diameter not less than 42.67 mm and a weight not greater than 45.93 g under the Rules of Golf as approved by R&A.

EXAMPLES

The present invention will next be described with reference to examples, which are not to be construed as limiting the invention.

Examples and Comparative Examples

Solid cores for golf balls of Examples 1 to 7 and Comparative Examples 1 to 9 were formed by the steps of: kneading corresponding rubber compositions for core use shown in Tables 1 to 4; and vulcanizing the resultant rubber materials for approximately 15 minutes at a temperature of 155° C. in corresponding core molds. In Tables 1 to 4, peroxide (1) is dicumyl peroxide commercially available from NOF Corp. under the trade name Percumyl D; peroxide (2) is 1,1-bis(t-butyl peroxy)3,3,5-trimethylcyclohexane commercially available from NOF Corp. under the trade name Perhexa 3M-40; antioxidant is that commercially available from Ouchi Shinko Chemical Industry Co., Ltd. under the trade name Nocrac NS-6; and zinc salt of pentachlorothiophenol is that commercially available from Bayer Corp. under the trade name Renacit IV.

The thus-obtained cores were covered with inner and outer cover layers of corresponding materials shown in Table 5 through injection molding, followed by normal coating to thereby manufacture multi-piece solid golf balls of Examples 1 to 7 and Comparative Examples 1 to 9.

In Tables 1 to 4, $S_R$ and $V_R$ of a golf ball were calculated according to the expressions mentioned previously, and the initial velocity of a golf ball and that of a core were measured by the method described previously.

The golf balls were tested for flight characteristics, durability against cracking, and feeling at impact by the following methods. Test results are shown in Tables 1 to 4.

Flight Performance

A golf ball was struck at a club head speed of 45 m/s by use of a driver (W #1) mounted on a swing robot, to thereby measure a launch angle, a travel distance, and a spin rate. A maximum angle from horizontal that a struck ball reached was measured by means of a camera positioned in parallel with a tee at a height of 1.6 m, and was defined as the launch angle. The driver used for the test was Tour Stage X100 (product of Bridgestone Sports Corp.; 10° loft angle). The travel distance was evaluated on the basis of the following criteria.

○: Total distance is 235 m or greater

X: Total distance is less than 234 m

Durability against Cracking

A golf ball was repeatedly struck at a club head speed of 40 m/s by use of a driver (W #1; 10° loft angle), to thereby measure the number of strikes at which the ball began to crack). Durability against cracking was evaluated under the following criteria. Notably, a ball was struck at a random point. Six balls each of Examples 1 to 7 and Comparative Examples 1 to 9 were tested.

○: 160 or more strikes at which a ball began to crack.

X: 150 or less strikes at which a ball began to crack.

Feeling

Three professional golfers struck the golf balls using a driver and a putter and evaluated their feelings about impact under the following criteria.

○: Good

X: Too soft or too hard

TABLE 1

| | | Example 1 | Example 2 | Example 3 | Example 4 |
|---|---|---|---|---|---|
| Number of dimples | | 432 | 432 | 432 | 392 |
| $S_R$ (%) | | 75.5 | 75.5 | 75.5 | 74.7 |
| $V_R$ (%) | | 0.779 | 0.779 | 0.779 | 0.754 |
| Ball | Diameter (mm) | 42.7 | 42.7 | 42.7 | 42.7 |
| | Weight (g) | 45.3 | 45.3 | 45.3 | 45.3 |
| | Initial Velocity (m/s) | 77.8 | 78.1 | 77.9 | 77.8 |
| Outer Cover | Cover Material | a | b | a | a |
| Layer | Thickness (mm) | 2.0 | 2.0 | 2.1 | 2.0 |

TABLE 1-continued

| | | Example 1 | Example 2 | Example 3 | Example 4 |
|---|---|---|---|---|---|
| Inner Cover Layer | Cover Material | f | f | d | f |
| | Thickness (mm) | 1.7 | 1.7 | 1.7 | 1.7 |
| Core | Diameter (mm) | 35.2 | 35.2 | 35.2 | 35.2 |
| | μ Hardness (mm) | 4.0 | 4.0 | 4.3 | 4.0 |
| Cover hardness | Shore D Hardness of Outer Cover Layer | 63 | 65 | 63 | 63 |
| | JIS C Hardness of Outer Cover Layer | 92 | 92 | 92 | 92 |
| | Shore D Hardness of Inner Cover Layer | 40 | 40 | 47 | 40 |
| | JIS C Hardness of Inner Cover Layer | 64 | 64 | 72 | 64 |
| Difference in Hardness between Cover and Core | Average JIS C Hardness of Cover: X | 79 | 79 | 82 | 79 |
| | JIS C Hardness of Core Surface: Y | 76 | 76 | 75 | 76 |
| | X-Y | 3 | 3 | 7 | 3 |
| Core Material | Polybutadiene | 100 | 100 | 100 | 100 |
| | Zinc acrylate | 29.4 | 29.4 | 27.5 | 29.4 |
| | Peroxide (1) | 0.6 | 0.6 | 0.6 | 0.6 |
| | Peroxide (2) | 0.6 | 0.6 | 0.6 | 0.6 |
| | Antioxidant | 0.2 | 0.2 | 0.2 | 0.2 |
| | Barium sulfate | — | — | — | — |
| | Zinc oxide | 22.7 | 22.7 | 30.1 | 22.7 |
| | Zinc salt of pentachlorothiophenol | 1.0 | 1.0 | 1.0 | 1.0 |
| | Zinc stearate | 5 | 5 | 5 | 5 |
| Flight | Launch angle (°) | 9.1 | 9.1 | 9.1 | 9.1 |
| | Carry (m) | 218.5 | 219.7 | 219.0 | 218.9 |
| | Total Distance (m) | 236.9 | 238.2 | 238.1 | 237.2 |
| | Spin (rpm) | 2562 | 2545 | 2551 | 2564 |
| | Evaluation of Distance | ○ | ○ | ○ | ○ |
| Durability against Cracking | | ○ | ○ | ○ | ○ |
| Feeling (W#1) | | ○ | ○ | ○ | ○ |
| Feeling (Putter) | | ○ | ○ | ○ | ○ |

Peroxide (1): Dicumyl peroxide - Percumyl D (NOF Corp.)
Peroxide (2): 1,1-bis(t-butyl peroxide)3,3,5-trimethylcyclohexane - Perhexa 3M-40 (NOF Corp.)
Antioxidant: Nocrac NS-6 (Ouchi Shinko Chemical Industry Co., Ltd.)
Zinc salt of pentachlorothiophenol: Renacit IV (Bayer Corp.)
μ Hardness: Deflection (deformation) amount of ball (mm) when load was increased from initial load of 98N(10 kgf) to 1275N(130 kgf)

TABLE 2

| | | Example 5 | Example 6 | Example 7 |
|---|---|---|---|---|
| Number of dimples | | 420 | 392 | 392 |
| $S_R$ (%) | | 78.1 | 75.1 | 75.1 |
| $V_R$ (%) | | 0.752 | 0.736 | 0.779 |
| Ball | Diameter (mm) | 42.7 | 42.7 | 42.7 |
| | Weight (g) | 45.3 | 45.3 | 45.3 |
| | Initial Velocity (m/s) | 77.8 | 77.8 | 77.8 |
| Outer Cover Layer | Cover Material | a | a | a |
| | Thickness (mm) | 2.0 | 2.0 | 2.1 |
| Inner Cover Layer | Cover Material | f | f | f |
| | Thickness (mm) | 1.7 | 1.7 | 1.7 |
| Core | Diameter (mm) | 35.2 | 35.2 | 35.2 |
| | μ Hardness (mm) | 4.0 | 4.0 | 4.0 |
| Cover hardness | Shore D Hardness of Outer Cover Layer | 63 | 63 | 63 |
| | JIS C Hardness of Outer Cover Layer | 92 | 92 | 92 |
| | Shore D Hardness of Inner Cover Layer | 40 | 40 | 40 |
| | JIS C Hardness of Inner Cover Layer | 64 | 64 | 64 |
| Difference in Hardness between Cover and Core | Average JIS C Hardness of Cover: X | 79 | 79 | 79 |
| | JIS C Hardness of Core Surface: Y | 76 | 76 | 76 |
| | X-Y | 3 | 3 | 3 |
| Core | Polybutadiene | 100 | 100 | 100 |

TABLE 2-continued

| | | Example 5 | Example 6 | Example 7 |
|---|---|---|---|---|
| Material | Zinc acrylate | 29.4 | 29.4 | 29.4 |
| | Peroxide (1) | 0.6 | 0.6 | 0.6 |
| | Peroxide (2) | 0.6 | 0.6 | 0.6 |
| | Antioxidant | 0.2 | 0.2 | 0.2 |
| | Barium sulfate | — | — | — |
| | Zinc oxide | 22.7 | 22.7 | 22.7 |
| | Zinc salt of pentachlorothiophenol | 1.0 | 1.0 | 1.0 |
| | Zinc stearate | 5 | 5 | 5 |
| Flight | Launch angle (°) | 9.2 | 9.2 | 8.9 |
| | Carry (m) | 218.7 | 218.8 | 217.0 |
| | Total Distance (m) | 236.7 | 237.4 | 235.0 |
| | Spin (rpm) | 2566 | 2558 | 2571 |
| | Evaluation of Distance | ○ | ○ | ○ |
| Durability against Cracking | | ○ | ○ | ○ |
| Feeling (W#1) | | ○ | ○ | ○ |
| Feeling (Putter) | | ○ | ○ | ○ |

TABLE 3

| | | Compara. Ex. 1 | Compara. Ex. 2 | Compara. Ex. 3 | Comprara. Ex. 4 | Compara. Ex. 5 |
|---|---|---|---|---|---|---|
| Number of dimples | | 432 | 432 | 432 | 392 | 392 |
| $S_R$ (%) | | 75.5 | 75.5 | 75.5 | 75.2 | 74.7 |
| $V_R$ (%) | | 0.779 | 0.779 | 0.779 | 0.830 | 0.710 |
| Ball | Diameter (mm) | 42.7 | 42.7 | 42.7 | 42.7 | 42.7 |
| | Weight (g) | 45.3 | 45.3 | 45.3 | 45.3 | 45.3 |
| | Initial Velocity (m/s) | 78.0 | 77.8 | 77.8 | 77.8 | 77.8 |
| Outer Cover Layer | Cover Material | b | b | b | a | a |
| | Thickness (mm) | 1.5 | 2.0 | 2.1 | 2.0 | 2.0 |
| Inner Cover Layer | Cover Material | a | a | e | f | f |
| | Thickness (mm) | 1.5 | 2.0 | 1.7 | 1.7 | 1.7 |
| Core | Diameter (mm) | 36.7 | 34.7 | 35.3 | 35.2 | 35.2 |
| | $\mu$ Hardness (mm) | 5.2 | 5.2 | 4.3 | 4.0 | 4.0 |
| Cover hardness | Shore D Hardness of Outer Cover Layer | 65 | 65 | 65 | 63 | 63 |
| | JIS C Hardness of Outer Cover Layer | 92 | 92 | 92 | 92 | 92 |
| | Shore D Hardness of Inner Cover Layer | 63 | 63 | 30 | 40 | 40 |
| | JIS C Hardness of Inner Cover Layer | 90 | 90 | 52 | 64 | 64 |
| Difference in Hardness between Cover and Core | Average JIS C Hardness of Cover: X | 91 | 91 | 74 | 79 | 79 |
| | JIS C Hardness of Core Surface: Y | 67 | 66 | 75 | 76 | 76 |
| | X-Y | 24 | 25 | −1 | 3 | 3 |
| Core Material | Polybutadiene | 100 | 100 | 100 | 100 | 100 |
| | Zinc acrylate | 20.5 | 20.5 | 27.5 | 29.4 | 29.4 |
| | Peroxide (1) | 0.6 | 0.6 | 0.6 | 0.6 | 0.6 |
| | Peroxide (2) | 0.6 | 0.6 | 0.6 | 0.6 | 0.6 |
| | Antioxidant | 0.2 | 0.2 | 0.2 | 0.2 | 0.2 |
| | Barium sulfate | — | — | — | — | — |
| | Zinc oxide | 35.0 | 41.2 | 27.3 | 22.7 | 22.7 |
| | Zinc salt of pentachlorothiophenol | 1.0 | 1.0 | 1.0 | 1.0 | 1.0 |
| | Zinc stearate | 5 | 5 | 5 | 5 | 5 |
| Flight | Launch angle (°) | 8.8 | 8.8 | 9.2 | 8.5 | 9.4 |
| | Carry (m) | 216.9 | 216.6 | 219.5 | 212.7 | 215.7 |
| | Total Distance (m) | 238.9 | 238.2 | 233.9 | 232.9 | 231.5 |
| | Spin (rpm) | 2246 | 2266 | 2693 | 2555 | 2568 |
| | Evaluation of Distance | ○ | ○ | X | X | X |
| Durability against Cracking | | X | ○ | X | ○ | ○ |
| Feeling (W#1) | | X | ○ | ○ | ○ | ○ |
| Feeling (Putter) | | ○ | X | ○ | ○ | ○ |

TABLE 4

| | | Compara. Ex. 6 | Compara. Ex. 7 | Compara. Ex. 8 | Compara. Ex. 9 |
|---|---|---|---|---|---|
| Number of dimples | | 500 | 336 | 432 | 432 |
| $S_R$ (%) | | 70.0 | 58.7 | 75.5 | 75.5 |
| $V_R$ (%) | | 0.794 | 0.797 | 0.779 | 0.779 |
| Ball | Diameter (mm) | 42.7 | 42.7 | 42.7 | 42.7 |
| | Weight (g) | 45.3 | 45.3 | 45.3 | 45.3 |
| | Initial Velocity (m/s) | 77.8 | 77.8 | 77.1 | 76.5 |
| Outer Cover Layer | Cover Material | a | a | a | c |
| | Thickness (mm) | 2.0 | 2.0 | 2.0 | 2.0 |
| Inner Cover Layer | Cover Material | f | f | f | f |
| | Thickness (mm) | 1.7 | 1.7 | 1.7 | 1.7 |
| Core | Diameter (mm) | 35.2 | 35.2 | 35.2 | 35.2 |
| | $\mu$ Hardness (mm) | 4.0 | 4.0 | 4.0 | 4.0 |
| Cover hardness | Shore D Hardness of Outer Cover Layer | 63 | 63 | 63 | 50 |
| | JIS C Hardness of Outer Cover Layer | 92 | 92 | 92 | 74 |
| | Shore D Hardness of Inner Cover Layer | 40 | 40 | 40 | 40 |
| | JIS C Hardness of Inner Cover Layer | 64 | 64 | 64 | 64 |
| Difference in Hardness between Cover and | Average JIS C Hardness of Cover: X | 79 | 79 | 79 | 70 |
| | JIS C Hardness of Core Surface: Y | 76 | 76 | 76 | 76 |

TABLE 4-continued

| | | Compara. Ex. 6 | Compara. Ex. 7 | Compara. Ex. 8 | Compara. Ex. 9 |
|---|---|---|---|---|---|
| Core | X-Y | 3 | 3 | 3 | −6 |
| Core | Polybutadiene | 100 | 100 | 100 | 100 |
| Material | Zinc acrylate | 29.4 | 29.4 | 24.0 | 29.4 |
| | Peroxide (1) | 0.6 | 0.6 | 0.6 | 0.6 |
| | Peroxide (2) | 0.6 | 0.6 | 0.6 | 0.6 |
| | Antioxidant | 0.2 | 0.2 | 0.2 | 0.2 |
| | Barium sulfate | — | — | 20.8 | — |
| | Zinc oxide | 22.7 | 22.7 | 5.0 | 22.7 |
| | Zinc salt of pentachlorothiophenol | 1.0 | 1.0 | 0.1 | 1.0 |
| | Zinc stearate | 5 | 5 | — | 5 |
| Flight | Launch angle (°) | 8.8 | 8.9 | 9.1 | 9.2 |
| | Carry (m) | 216.4 | 213.6 | 214.6 | 213.4 |
| | Total Distance (m) | 232.7 | 228.7 | 232.9 | 227.1 |
| | Spin (rpm) | 2565 | 2570 | 2576 | 2680 |
| | Evaluation of Distance | X | X | X | X |
| Durability against Cracking | | ○ | ○ | ○ | ○ |
| Feeling (W#1) | | ○ | ○ | ○ | ○ |
| Feeling (Putter) | | ○ | ○ | ○ | ○ |

TABLE 5

| | Cover Material (Unit: Parts by Weight) | | | | | |
|---|---|---|---|---|---|---|
| | a | b | c | d | e | f |
| Himilan 1706 | 50 | — | — | — | — | — |
| Himilan 1557 | — | — | 20 | — | — | — |
| Himilan 1855 | — | — | 30 | — | — | — |
| AM7317 | — | 50 | — | — | — | — |
| Himilan 1605 | 50 | — | — | — | — | — |
| Himilan 1601 | — | — | — | — | — | — |
| Surlyn 8120 | — | — | 30 | — | — | — |
| AM7318 | — | 50 | — | — | — | — |
| Nucrel AN4311 | — | — | 20 | — | — | — |
| Hytrel 3078 | — | — | — | — | 100 | — |
| HytreI 4047 | — | — | — | — | — | 100 |
| Hytrel 4767 | — | — | — | 100 | — | — |
| Titanium Oxide | 5 | 5 | 5 | — | — | — |
| Shore D Hardness | 63 | 65 | 50 | 47 | 30 | 40 |
| JIS C Hardness | 92 | 96 | 74 | 72 | 52 | 64 |

Himilan: Trade name of an ionomer resin from Du Pont Mitsui Polychemicals Co., Ltd.
Surlyn: Trade name of an ionomer resin from Du Pont, Ltd.
Hytrel: Trade name of a polyester-based thermoplastic elastomer from Toray DuPont, AM7317, AM7318: Trade names of high-rigidity ionomer resins from Du Pont Mitsui Polychemicals Co., Ltd.
Nucrel AN4311: Trade name of a ternary copolymer of ethylene, methacrylic acid, and acrylic ester from Du Pont Mitsui Polychemicals Co., Ltd.

As seen from Tables 1 to 4, the multi-piece solid golf balls of the present invention have an initial velocity in excess of that prescribed by R&A and USGA through specification of conditions with respect to dimples, core hardness, and cover hardness, among others, to thereby enable a golfer who has a rather low club head speed to drive the ball a long distance. The golf balls of the present invention are also satisfactory with respect to durability against cracking and feeling at impact.

By contrast, the golf balls of Comparative Examples involve the following drawbacks.

Comparative Example 1

Since the value obtained through subtraction of the JIS C hardness of a surface portion of the core from the average JIS C hardness of the cover exceeds 20, the durability of the ball against cracking is low, and the feeling upon being hit by a driver is excessively soft.

Comparative Example 2

As a result of increasing the thickness of the inner and outer cover layers in order to improve the durability of the ball against cracking of Comparative Example 1, the feeling upon being hit by a putter becomes excessively hard.

Comparative Example 3

Since the value obtained through subtraction of the JIS C hardness of a surface portion of the core from the average JIS C hardness of the cover is less than 0, the spin upon being hit by a driver increases excessively, with a resultant decrease in travel distance. Further, since the inner cove layer is made soft, the durability of the ball against cracking is low.

Comparative Example 4

Due to high $V_R$, lift is insufficient, and the launch angle decreases with a resultant decrease in travel distance.

Comparative Example 5

Due to low $V_R$, the ball pops up with a resultant decrease in travel distance.

Comparative Example 6

Due to an excessively large number of dimples, the launch angle is small. Thus, the ball lands in a shorter distance than a ball of the present invention.

Comparative Example 7

Due to a small number of dimples and low $S_R$, the optimum lift-to-drag ratio is not obtained, with a resultant failure to yield sufficient travel distance.

Comparative Example 8

Since the core material does not contain a zinc salt of pentachlorothiophenol, initial velocity becomes low. Thus, the ball lands in a shorter distance than a ball of the present invention.

Comparative Example 9

Since the outer cover layer is soft, and the value obtained through subtraction of the JIS C hardness of a surface portion of the core from the average JIS C hardness of the cover is less than 0, initial velocity becomes low. Thus, the ball lands in a shorter distance than a ball of the present invention.

What is claimed is:

1. A multi-piece solid golf ball comprising a core and a multi-layer cover, said golf ball satisfying the following conditions (1) to (5):

(1) the number of dimples is 360 to 492;

(2) total volume enclosed by the dimples as expressed as a percentage of the volume of the golf ball, $V_R$, is 0.715% to 0.825%;

(3) total surface area of the dimples as expressed as a percentage of the surface area of the golf ball, $S_R$, is not less than 70%;

(4) value obtained through subtraction of JIS C hardness of a surface portion of the core from average JIS C hardness of the cover is 3 to 15; and (5) initial velocity is in excess of 77.7 m/s (255 ft/s).

2. A multi-piece solid golf ball as defined in claim 1, wherein the total volume enclosed by dimples as expressed as a percentage of the volume of the golf ball, $V_R$, is expressed as below $$V_R = \frac{V_S}{\frac{4}{3}\pi R^3} \times 100$$

(where $V_S$ is total space volume of dimples, each having a dimple space volume $V_P$, and R is the radius of the golf ball (an imaginary sphere), The dimple space volume $V_P$ is defined as the volume of a space enclosed by a dimple surface and a plane surrounded by an edge of the dimple.

3. A multi-piece solid golf ball as defined in claim 1, wherein the total surface area of dimples as expressed as a percentage of the surface area of the golf ball, $S_R$, is expressed as below $$S_R = \frac{S_S}{4\pi R^2}$$

(where $S_S$ is total surface area of dimples, and R is the radius of a golf ball (an imaginary sphere), The surface area of a dimple is defined as the area of a dimple surface below the plane surrounded by the dimple edge.

4. A multi-piece solid golf ball as defined in claim 1, wherein the average JIS C hardness of the cover is a value obtained by dividing the sum of the product, for each layer, of JIS C hardness and thickness, by the sum of the thicknesses of the layers.

5. A multi-piece solid golf ball as defined in claim 1, wherein the number of dimples is 380 to 460.

6. A multi-piece solid golf ball as defined in claim 1, wherein the total volume enclosed by the dimples as expressed as a percentage of the volume of said golf ball, $V_R$, is 0.73% to 0.80%.

7. A multi-piece solid golf ball as defined in claim 1, wherein the total surface area of the dimples as expressed as a percentage of the surface area of said golf ball, $S_R$, is 72% to 80%.

8. A multi-piece solid golf ball as defined in claim 1, wherein the initial velocity is in excess of 78.0 m/s.

9. A multi-piece solid golf ball as defined in claim 1, wherein a core material contains pentachlorothiophenol or a metallic salt of pentachlorothiophenol.

10. A multi-piece solid golf ball as defined in claim 1, wherein a value obtained through subtraction of the average JIS C hardness of the inner cover layer from the JIS C hardness of the outermost cover layer falls within a range of −10 to 40.

* * * * *